US008172168B2

(12) United States Patent
Hoffmann et al.

(10) Patent No.: US 8,172,168 B2
(45) Date of Patent: May 8, 2012

(54) ROLLER GRINDING MILL

(75) Inventors: Dirk Hoffmann, Trippstadt (DE); Otto Jung, Huetschenhausen (DE); Karl-Heinz Schuette, Trippstadt (DE); Hardy Lessmeister, Kaiserslautern (DE); Thomas Hoster, Kaiserslautern (DE)

(73) Assignee: Gebr. Pfeiffer AG, Kaiserslautern (DE)

( * ) Notice: Subject to any disclaimer, the term of this patent is extended or adjusted under 35 U.S.C. 154(b) by 0 days.

(21) Appl. No.: 12/886,296

(22) Filed: Sep. 20, 2010

(65) Prior Publication Data

US 2011/0068203 A1 Mar. 24, 2011

Related U.S. Application Data

(63) Continuation of application No. PCT/EP2009/001691, filed on Mar. 10, 2009.

(30) Foreign Application Priority Data

Mar. 20, 2008 (DE) ..... 10 2008 015 141

(51) Int. Cl.
*B02C 15/00* (2006.01)

(52) U.S. Cl. ..... 241/121

(58) Field of Classification Search ..... 241/117–121
See application file for complete search history.

(56) References Cited

U.S. PATENT DOCUMENTS

| | | | | |
|---|---|---|---|---|
| 3,782,646 | A | 1/1974 | Brundiek | |
| 4,887,489 | A | 12/1989 | Sigg | |
| 6,021,968 | A | 2/2000 | Brundiek et al. | |
| 7,597,281 | B2 * | 10/2009 | Letsch | 241/121 |
| 7,637,446 | B2 * | 12/2009 | Euculano | 241/121 |
| 2008/0041990 | A1 * | 2/2008 | Letsch | 241/121 |
| 2008/0245907 | A1 | 10/2008 | Loesche | |
| 2009/0314866 | A1 * | 12/2009 | Hoffmann et al. | 241/120 |
| 2010/0059611 | A1 * | 3/2010 | Berger et al. | 241/30 |

FOREIGN PATENT DOCUMENTS

| | | |
|---|---|---|
| DE | 2 124 521 | 12/1972 |
| DE | 76 20 223 U | 12/1976 |
| DE | 33 20 037 C1 | 11/1984 |
| DE | 35 07 913 A1 | 9/1986 |
| DE | 37 12 562 C1 | 5/1988 |
| DE | 39 31 116 C2 | 3/1991 |
| DE | 196 03 655 A1 | 8/1997 |
| DE | 198 26 324 C1 | 8/1999 |
| DE | 103 43 218 A1 | 5/2005 |
| EP | 0 406 644 A2 | 9/1991 |

* cited by examiner

*Primary Examiner* — Faye Francis
(74) *Attorney, Agent, or Firm* — Muncy, Geissler, Olds & Lowe, PLLC

(57) ABSTRACT

A roller grinding mill is provided that includes a grinding plate, grinding rollers, and at least two drives acting upon the grinding plate, and to a method for operating such a roller grinding mill. At least one grinding roller and substantially simultaneously at least one matching drive can be disengaged during operation. Thus only small radial forces are created that effect the radial bearing of the grinding plate.

8 Claims, 5 Drawing Sheets a)

b)

c)

d)

ROLLER GRINDING MILL

This nonprovisional application is a continuation of International Application No. PCT/EP2009/001691, which was filed on Mar. 10, 2009, and which claims priority to German Patent Application No. DE 10 2008 015 141.6, which was filed in Germany on Mar. 20, 2008, and which are both herein incorporated by reference.

BACKGROUND OF THE INVENTION

1. Field of the Invention

The invention relates to roller grinding mills.

2. Description of the Background Art

Roller grinding mills have been known for more than a hundred years, and are used throughout the world. They exist in an extremely wide variety of designs. Thus, for example, DE 153 958 C from 1902 shows a cone mill with a revolving grinding plate on which rest eight grinding cones under spring pressure.

Modern mills use grinding rollers that have heavy weights and large diameters to achieve high milling output. Please see DE 198 26 324 C, DE 196 03 655 A, which corresponds to U.S. Pat. No. 6,021,968, and also EP 0 406 644 B. This type of roller grinding mill has gained extremely wide acceptance in practice because it has considerable advantages with regard to design, control, and energy economy. The chief areas of application for modern roller grinding mills are the cement industry and coal-fired power plants. In the cement industry, roller grinding mills are used for producing raw cement meal as well as for clinker grinding and coal grinding. In combination with rotary kilns and calcining installations, the furnace exhaust gases from the heat exchanger and clinker cooler can be used to dry the grinding stock and pneumatically transport the ground stock. In power plants, the roller grinding mills are used to finely grind the coal and feed it directly into the boiler with the aid of the classifier air, if possible without the use of an intermediate bunker.

Modern large mills require drive power levels of up to 10 MW. It is a matter of course that the associated bearings and drives, in particular the transmissions, must be of special design. The teeth, the shaft bearings, the integrated axial thrust bearings and their supports within the transmission housing, are particularly heavily loaded. For drive power levels up to 6 MW, planetary bevel gear transmissions, which are matched to the circular grinding plate on account of their circular shape, have become established as the state of the art; they transmit the static and dynamic grinding forces to the foundation. Please see DE 35 07 913 A or DE 37 12 562 C, which corresponds to U.S. Pat. No. 4,887,489. Pivoted-pad bearings with hydrodynamic and/or hydrostatic lubrication are used as axial thrust bearings; please see DE 33 20 037 C.

These designs, space-saving in and of themselves, have significant disadvantages, however. As soon as a problem arises with just one component, the entire drive must be dismantled. It has proven to be particularly disadvantageous in this regard that it is extremely difficult to visually inspect the gears of the planetary transmission; oftentimes, this is not possible until the drive has been dismantled completely. Since these drives are special designs, procurement of replacement parts takes a commensurately long time, i.e., weeks or months, since stocking of replacement parts is considered too cost-intensive on account of the special designs. This is unsatisfactory.

Another disadvantage of the prior art drive design is what is called the maintenance drive, which rotates the grinding plate during certain maintenance and repair operations, but which only functions as long as the primary transmission itself functions.

Naturally, there has been no shortage of proposals for doing away with these inadequacies and disadvantages. Thus, DE 39 31 116 C shows a drive device for a roller grinding mill having a grinding plate that can rotate about a vertical axis, which has a crown gear connected to the lower part of the grinding plate. Moreover, two diagonally arranged drives are provided, each having a drive motor and a gear reducer. Each gear reducer has two pinions that mesh with the crown gear of the grinding plate.

Known from DE 76 29 223 U is a roller grinding mill with a ring gear located under its grinding plate. The pinions of four hydraulic motors fastened to the base of the mill housing mesh with the ring gear.

Despite the theoretical advantages of these multiple-motor drive concepts, they have as yet been unable to gain acceptance in practice. In the case of hydraulic drives, the lower efficiency as compared with electric drives, and the lower availability and service life of the hydraulic components are disadvantages. The previously described dual-drive concept with electric motors and gear reducer was unable to gain acceptance because considerable excess torques arise during operation, which can result in overloading of the transmission to the point of destruction. Moreover, it was not possible to support mill operation with the required capacity in the event of the failure of a drive.

However, it is not only the required drive power level that has increased with the increasing capacity of roller grinding mills, but also the number of grinding rollers rolling on the grinding plate. Thus, DE 103 43 218 B4, which corresponds to U.S. Publication NO. 20080245907, describes a roller grinding mill with six grinding rollers and a single drive. Here, the design is arranged such that two diagonally opposite grinding rollers can be pivoted out simultaneously, and the mill is intended to produce 80% of the full milling output with the remaining four active grinding rollers. A disadvantage in this design is that two grinding rollers always have to be pivoted out, even when only one grinding roller has failed.

DE-OS 21 24 521 has also already described a roller grinding mill with six grinding rollers.

Finally, a roller grinding mill with four grinding rollers is known from DE 197 02 854 A1, in which each grinding roller is driven by a separate drive, having an electric motor and gear reducer. The grinding plate itself does not have a drive. No provision is made for deactivation of one or more grinding rollers or of one or more drives.

SUMMARY OF THE INVENTION

The object of the present invention is to specify roller grinding mills with at least two grinding rollers and at least two drives, in which only low forces, which do not overload the radial bearing, arise on the radial bearing of the grinding plate when a single grinding roller is deactivated.

If, in contrast to the teaching in the above cited DE 103 43 218 B4, one removes just a single grinding roller rather than two diagonally opposite grinding rollers, then a substantial radial force component acts on the grinding plate, produced by the remaining grinding rollers. This radial force component loads the axial and, in particular, the radial bearing of the grinding plate to a substantial degree. The bearing of the grinding plate would thus have to be considerably oversized. However, it has been found that this is not necessary, or is necessary only to a significantly reduced degree, if, in accordance with the invention, the grinding plate is driven by multiple drives distributed about its circumference, and the matching drive is deactivated at the same time as the grinding roller. The term "matching drive" is understood to mean the drive for which only a minimal resultant radial force arises on its deactivation.

It is a matter of course that the same beneficial effect is also achieved if the matching grinding roller is deactivated when a drive fails.

When a grinding roller fails and the corresponding drive is then removed, the milling output would normally drop accordingly. Now, it is known that the milling output can be increased by increasing the contact force and boosting the classifier air. However, this would nullify the compensating effect achieved by removing the drive. The solution to this problem is to raise the drive force of the remaining drives along with increasing the contact force of the grinding rollers in order to achieve the necessary throughput.

According to an embodiment of the invention, the grinding plate is equipped with a crown gear, which the drives act upon.

To make it possible to lift the grinding rollers individually from the grinding track and pivot them out of the mill, they are mounted by means of rocker arms on brackets standing next to the mill housing.

The deactivation of a drive can be accomplished in the simplest case by switching off the drive energy, for example the electric power, so that the transmission and motor run idle.

However, it is more advantageous if the drive is decoupled from the grinding plate. According to one embodiment, the drives can travel on carriages or rails for this purpose.

Surprisingly, it has been found that the radial force component remaining when a drive and a grinding roller are deactivated can be reduced still further if the angle between the grinding rollers and the drives is changed. To this end, the angular positions of the drives are adjustable about the center of the mill.

Another embodiment of the invention provides for compensating the radial force component arising when a grinding roller or drive fails by the means that the remaining grinding rollers themselves generate an opposing force component. To this end, according to one embodiment of the invention the grinding rollers can be set at an angle, i.e. rotated with respect to the tangential position.

A further development of the invention provides for the number of drives to be equal to the number of grinding rollers.

An especially economical embodiment of the invention provides for the grinding rollers with the rocker arms and the drives to be prefabricated in modular form. A larger or smaller number of roller modules or drive modules are used in accordance with the wishes of the mill operator. In this way, mill components such as grinding rollers, rocker arms, motors and transmissions can be mass-produced and kept in stock for repairs.

An additional object of the invention is a method for operating a roller grinding mill that makes it possible to compensate the radial force component arising when a grinding roller fails, so that overloading of the grinding plate bearing is avoided.

A further reduction in the resultant radial force component is achieved when the angular position of at least one of the remaining drives is changed such that the resultant radial force is minimal.

A final possibility for reducing the radial force component is in setting the remaining grinding rollers at an angle so that the resultant radial force is minimal.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
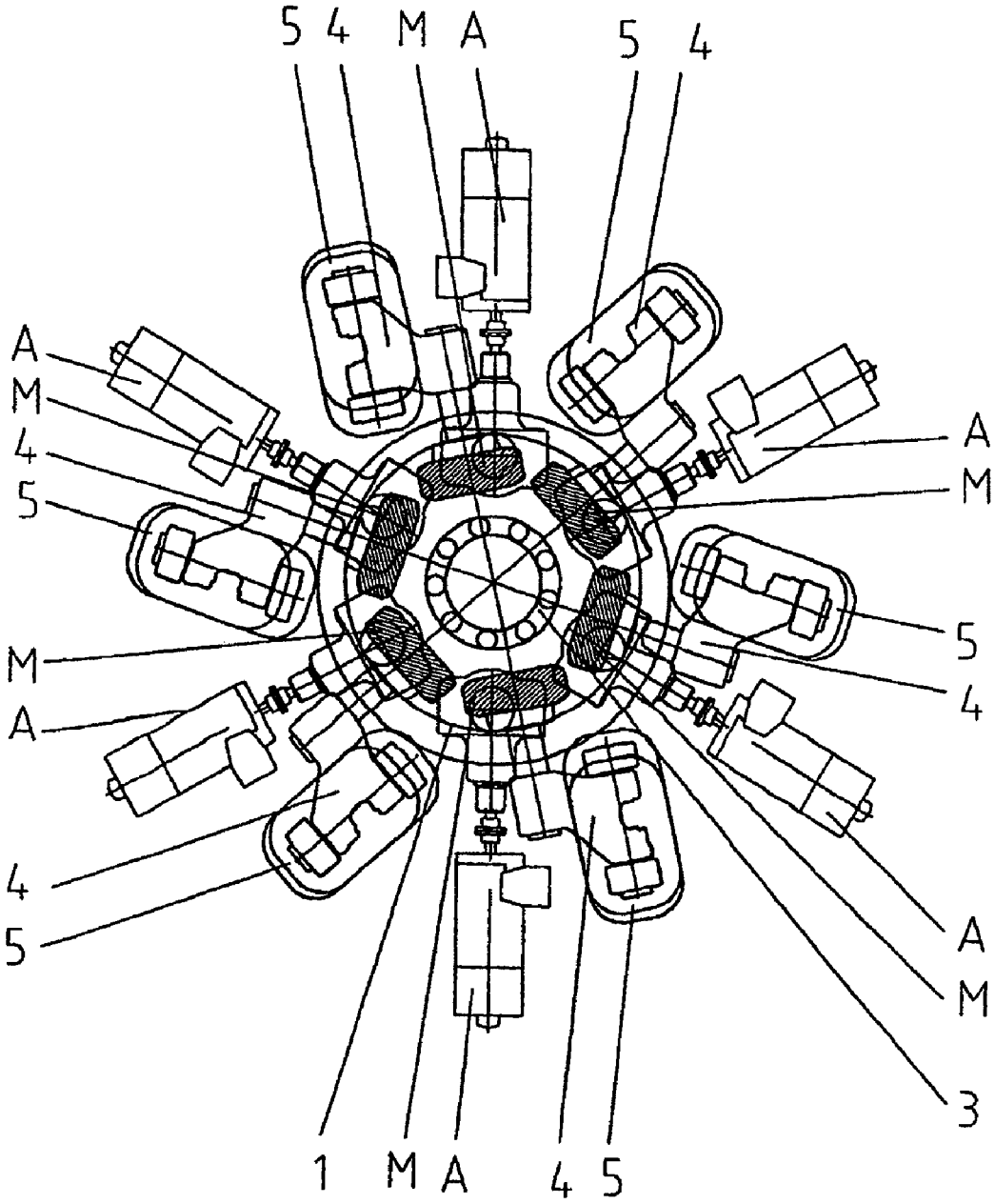
FIG. 1 a top view of a roller grinding mill with six grinding rollers pivotably mounted on brackets and six separate drives.

FIG. 1 shows a top view of a roller grinding mill with a rotating grinding plate 1, upon whose grinding track roll six grinding rollers M. The grinding plate 1 is supported by an axial bearing and a radial bearing 3. Each grinding roller M is mounted by means of a rocker arm 4 on an external bracket 5, so that each grinding roller M can be lifted individually from the grinding track and pivoted out of the mill. This makes it possible to carry out maintenance or repair of a grinding roller while milling operation continues.

Also visible between the six grinding rollers M are six drives A, including motors, preferably electric motors, and transmissions. All drives A act on a crown gear (not shown), which is attached to the grinding plate 1.

In order to be able to decouple the drives A from the grinding plate 1, they are mounted on carriages or rails (not shown).

Figure 2:
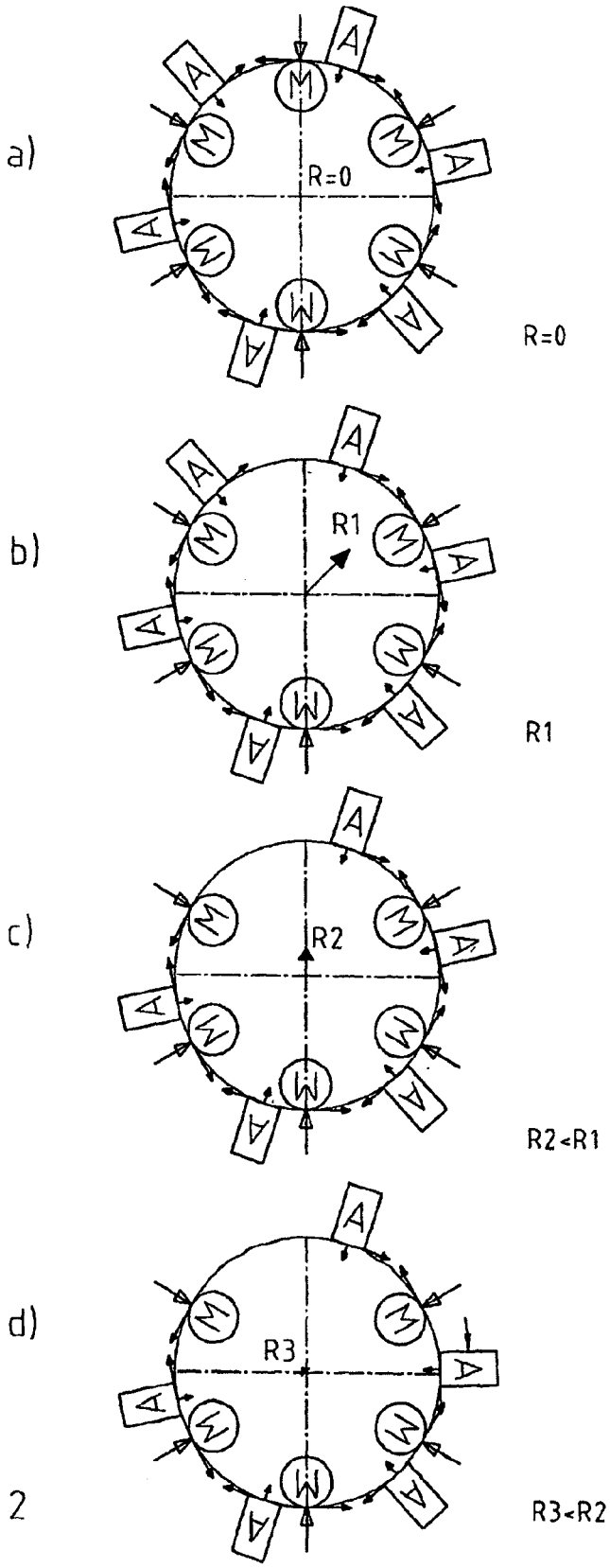
FIG. 2 the radial forces produced during operation of the mill from FIG. 1 under various operating conditions.

FIG. 2*a* shows, purely schematically, the mill from FIG. 1. The grinding plate, on which roll the six grinding rollers, is visible. The grinding plate is driven by the six drives A distributed about the circumference. Since all radial forces mutually compensate one another in this symmetrical arrangement, the resultant radial force R is equal to zero.

FIG. 2*b* shows the mill from FIG. 2*a*, but with one grinding roller M pivoted out. A resultant radial force component of magnitude R1 arises.

FIG. 2*c* shows the situation when, in addition to the grinding roller M, the adjacent "matching" drive A has been deactivated. The resultant radial force component has been reduced to R2<R1.

FIG. 2*d* shows the situation when, in addition to the action from FIG. 2*c*, the angular position of the drive indicated by an arrow is changed. The radial force R3 has decreased almost to zero.

Figure 3:
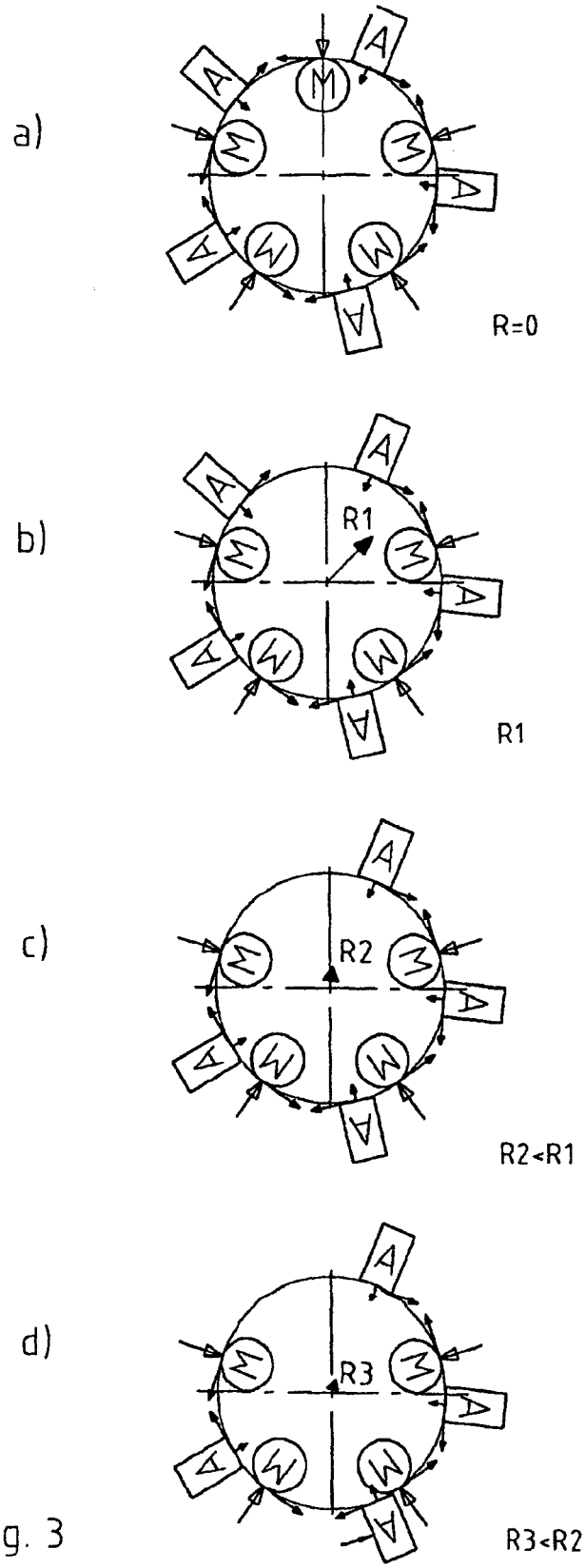
FIG. 3 the radial forces produced during operation of a mill with five grinding rollers and five drives.

FIG. 3*a* shows, purely schematically, a roller grinding mill that has five grinding rollers M rolling on its grinding plate and that is set in rotation by five drives A. Because of the symmetrical arrangement, the resultant radial force component R=0.

FIG. 3*b* shows the situation when one of the grinding rollers M has been pivoted out. A resultant radial force component R1 arises.

FIG. 3*c* shows the situation when, in addition to the grinding roller M, the adjacent "matching" drive A has also been deactivated. In this way, the resultant radial force component has been reduced to R2<R1.

FIG. 3*d* shows the situation when, in addition to the action from FIG. 3*c*, the angular position of the drive indicated by an arrow is changed. The radial force R3 has decreased almost to zero.

Figure 4:
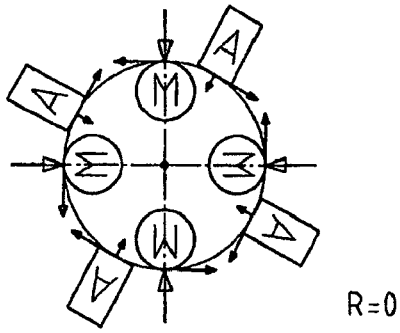
FIG. 4 the radial forces produced during operation of a roller grinding mill with four grinding rollers and four drives under various operating conditions.
Figure 4:
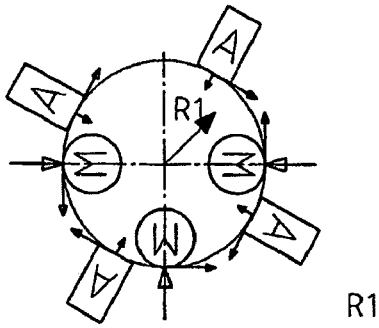
Figure 4:
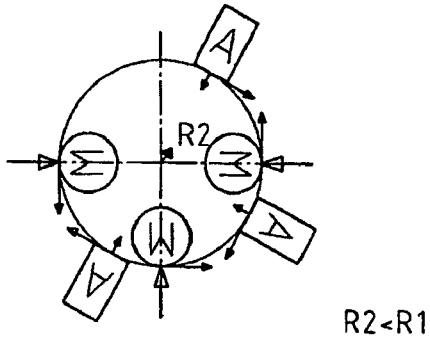
Figure 4:
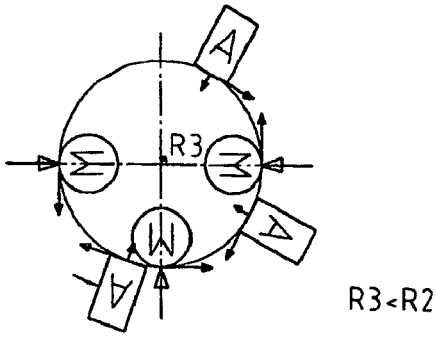

FIG. 4*a* shows a roller grinding mill whose grinding plate is driven by four drives A, and that has four grinding rollers M rolling on its grinding plate. Because of the symmetrical arrangement, the resultant radial force component R=0.

FIG. 4*b* shows the situation when one of the grinding rollers M has been pivoted out. A resultant radial force component of magnitude R1 arises.

FIG. 4*c* shows the situation when, in addition to the grinding roller M, the adjacent drive A has also been deactivated. The resultant radial force component has been reduced to R2<R1.

FIG. 4*d* shows the situation when, in addition to the action from FIG. 4*c*, the angular position of the drive indicated by an arrow is changed. The radial force R3 has decreased almost to zero.

Figure 5:
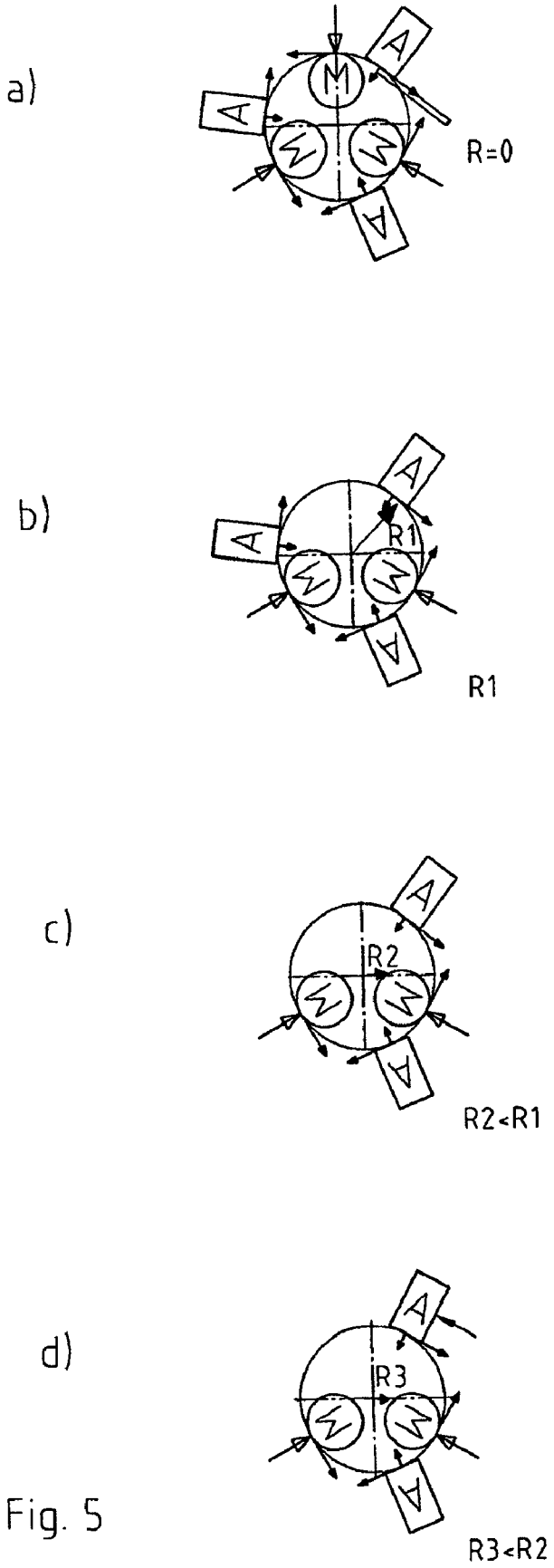
FIG. 5 the radial forces of a roller grinding mill with three grinding rollers and three drives under various operating conditions.

FIG. 5*a* shows a roller grinding mill whose grinding plate is driven by three drives A, and that has three grinding rollers M rolling on its grinding plate. Because of the symmetrical arrangement, the resultant radial force component R=0.

FIG. 5*b* shows the situation when one of the grinding rollers M has been pivoted out. A resultant radial force component of magnitude R1 arises.

FIG. 5*c* shows the situation when, in addition to the grinding roller M, the adjacent drive A has also been deactivated. In this way, the resultant radial force component has been reduced to R2<R1.

FIG. 5*d* shows the situation when, in addition to the action from FIG. 5*c*, the angular position of the drive indicated by an arrow is changed. The radial force R3 has decreased almost to zero.

The example embodiments from FIGS. 2*a* to 5*d* show that the invention can be used in all roller grinding mills, regardless of the number of grinding rollers, when the grinding plate is set in rotation by a corresponding number of drives.

Moreover, it is a matter of course that not only one grinding roller and one drive can be deactivated at a time, as shown in the figures. The inventive principle also works when multiple grinding rollers and the "matching" drives are deactivated, with there being no necessity to deactivate only radially opposite units, which obviously would only be possible when an even number of grinding rollers and drives is provided.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A roller grinding mill comprising:

a housing;

a grinding plate with grinding track;

grinding rollers that roll on the grinding track, the grinding rollers being configured to be brought out of engagement;

an axial bearing for the grinding plate;

a radial bearing for the grinding plate;

at least two drives with motor and transmission and that are configured to drive the grinding plate;

wherein the drives are deactivatable while operation continues;

wherein a matching drive for a grinding roller that has been brought out of engagement is deactivatable; and wherein the matching drive is the drive for which only a minimal resultant radial force arises on its deactivation.

2. The roller grinding mill according to claim 1, wherein the grinding plate is equipped with a crown gear, which the drives act upon.

3. The roller grinding mill according to claim 1, wherein the grinding rollers are separately mounted on brackets via rocker arms.

4. The roller grinding mill according to claim 1, wherein the drives are configured to travel on carriages or rails.

5. The roller grinding mill according to claim 1, wherein an angular position of at least one drive is adjustable.

6. The roller grinding mill according to claim 1, wherein the grinding rollers are configured to be set at an angle.

7. The roller grinding mill according to claim 1, wherein the number of drives is equal to the number of grinding rollers.

8. The roller grinding mill according to claim 1, wherein the grinding rollers with rocker arms and the drives are each prefabricated in modular form.

* * * * *